US006286803B1

(12) United States Patent
Pellino et al.

(10) Patent No.: US 6,286,803 B1
(45) Date of Patent: Sep. 11, 2001

(54) DEVICE TO ASSIST IN PROPER PICTURE HANGING

(76) Inventors: Cara Pellino; Joseph Pellino, both of 165 Huntcliff Ct., Marietta, GA (US) 30066

( * ) Notice: Subject to any disclaimer, the term of this patent is extended or adjusted under 35 U.S.C. 154(b) by 0 days.

(21) Appl. No.: 09/616,793

(22) Filed: Jul. 14, 2000

(51) Int. Cl.[7] ..... A47G 1/24
(52) U.S. Cl. ..... 248/490; 248/475.1
(58) Field of Search ..... 248/490, 475.1, 248/476, 477, 495, 497; 40/713

(56) References Cited

U.S. PATENT DOCUMENTS 3,516,165 6/1970 Pfeffer ..... 33/180
4,473,957 * 10/1984 Faulkner ..... 33/189 X
4,893,776 1/1990 Floyd ..... 248/475.1
5,129,154 * 7/1992 Aydelott ..... 33/613
5,605,313 2/1997 Erickson ..... 248/467

* cited by examiner

*Primary Examiner*—Ramon O. Ramirez
*Assistant Examiner*—A. Joseph Wujciak
(74) *Attorney, Agent, or Firm*—Goldstein Law Offices, P.C.

(57) ABSTRACT

A device to assist in proper picture hanging including a bracket having a generally inverted J-shaped configuration. The bracket is comprised of an adjustable vertical component and an adjustable horizontal component. The bracket is positionable with respect to the framed picture with the horizontal component spanning the upper edge and the vertical component positioned on the back face. A marking protrusion is secured to the lower segment of the vertical component of the bracket.

6 Claims, 2 Drawing Sheets

DEVICE TO ASSIST IN PROPER PICTURE HANGING

BACKGROUND OF THE INVENTION

The present invention relates to a device to assist in proper picture hanging and more particularly pertains to allowing framed pictures to be hung straight and in a preferred location in an easy manner.

The use of picture hanging devices is known in the prior art. More specifically, picture hanging devices heretofore devised and utilized for the purpose of facilitating the hanging of pictures are known to consist basically of familiar, expected and obvious structural configurations, notwithstanding the myriad of designs encompassed by the crowded prior art which have been developed for the fulfillment of countless objectives and requirements.

By way of example, U.S. Pat. No. 4,893,776 to Floyd discloses a picture hanging device comprised of a plunger assembly capable of being depressed to mark a point on a wall. U.S. Pat. No. 5,129,154 to Aydelott discloses a marking device comprised of a rigid handle connected with a pivoting assembly which holds a wall marking element, such as a pin. U.S. Pat. No. 3,516,165 to Pfeffer discloses a picture hanging device comprised of a flat elongated tool with a pointed element affixed to one end. U.S. Pat. No. 5,603,313 to Erickson discloses an object hanging device.

While these devices fulfill their respective, particular objective and requirements, the aforementioned patents do not describe a device to assist in proper picture hanging for allowing framed pictures to be hung straight and in a preferred location in an easy manner.

In this respect, the device to assist in proper picture hanging according to the present invention substantially departs from the conventional concepts and designs of the prior art, and in doing so provides an apparatus primarily developed for the purpose of allowing framed pictures to be hung straight and in a preferred location in an easy manner.

Therefore, it can be appreciated that there exists a continuing need for a new and improved device to assist in proper picture hanging which can be used for allowing framed pictures to be hung straight and in a preferred location in an easy manner. In this regard, the present invention substantially fulfills this need.

SUMMARY OF THE INVENTION

In the view of the foregoing disadvantages inherent in the known types of picture hanging devices now present in the prior art, the present invention provides an improved device to assist in proper picture hanging. As such, the general purpose of the present invention, which will be described subsequently in greater detail, is to provide a new and improved device to assist in proper picture hanging which has all the advantages of the prior art and none of the disadvantages.

To attain this, the present invention essentially comprises a bracket having a generally inverted J-shaped configuration. The bracket is comprised of an adjustable vertical component and an adjustable horizontal component. The vertical component includes an upper segment and a lower segment slidably coupled together. The horizontal component includes an inner segment and an outer segment slidably coupled together. The outer segment has a free end with a downwardly extending lip. The inner segment is secured to the upper segment in an orthogonal relationship. The vertical component and the horizontal component each have an interior surface coated with a protective coating. The bracket is positionable with respect to the framed picture with the horizontal component spanning the upper edge and the vertical component positioned on the back face. A marking protrusion is secured to the lower segment of the vertical component of the bracket. The marking protrusion includes a padded disk. The padded disk has a pointed member extending outwardly therefrom. A level is secured to the outer segment of the horizontal component of the bracket.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved device to assist in proper picture hanging which has all the advantages of the prior art picture hanging devices and none of the disadvantages.

It is another object of the present invention to provide a new and improved device to assist in proper picture hanging which may be easily and efficiently manufactured and marketed.

It is a further object of the present invention to provide a new and improved device to assist in proper picture hanging which is of durable and reliable construction.

An even further object of the present invention is to provide a new and improved device to assist in proper picture hanging which is susceptible of a low cost of manufacture with regard to both materials and labor, and which accordingly is then susceptible of low prices of sale to the consuming public, thereby making such a device to assist in proper picture hanging economically available to the buying public.

Even still another object of the present invention is to provide a new and improved device to assist in proper picture hanging for allowing framed pictures to be hung straight and in a preferred location in an easy manner.

Lastly, it is an object of the present invention to provide a new and improved device to assist in proper picture hanging including a bracket having a generally inverted J-shaped configuration. The bracket is comprised of an adjustable vertical component and an adjustable horizontal component. The bracket is positionable with respect to the framed picture with the horizontal component spanning the upper edge and the vertical component positioned on the back face. A marking protrusion is secured to the lower segment of the vertical component of the bracket.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various figures.

DESCRIPTION OF THE PREFERRED EMBODIMENT

Figure 2:
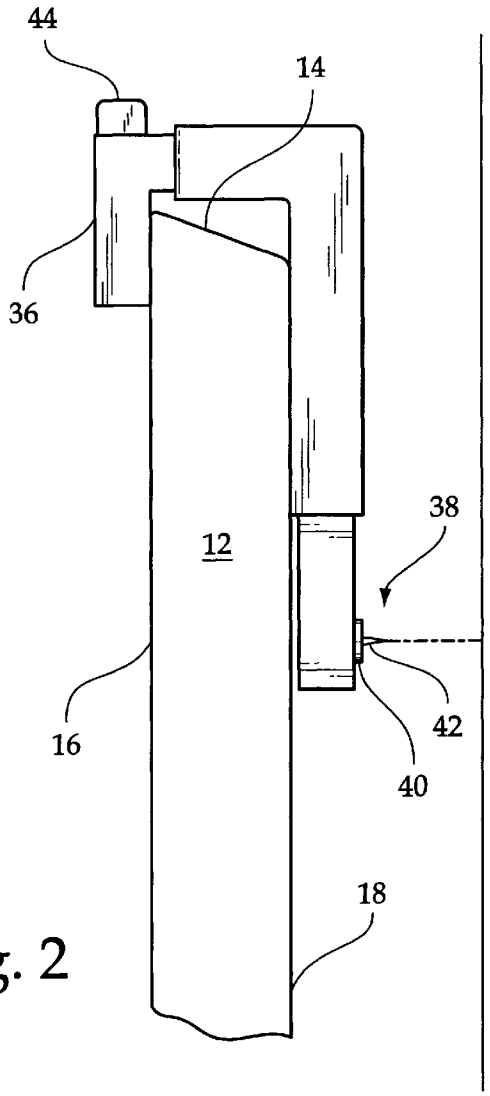
FIG. 2 is a side elevation view of the present invention.
Figure 1:
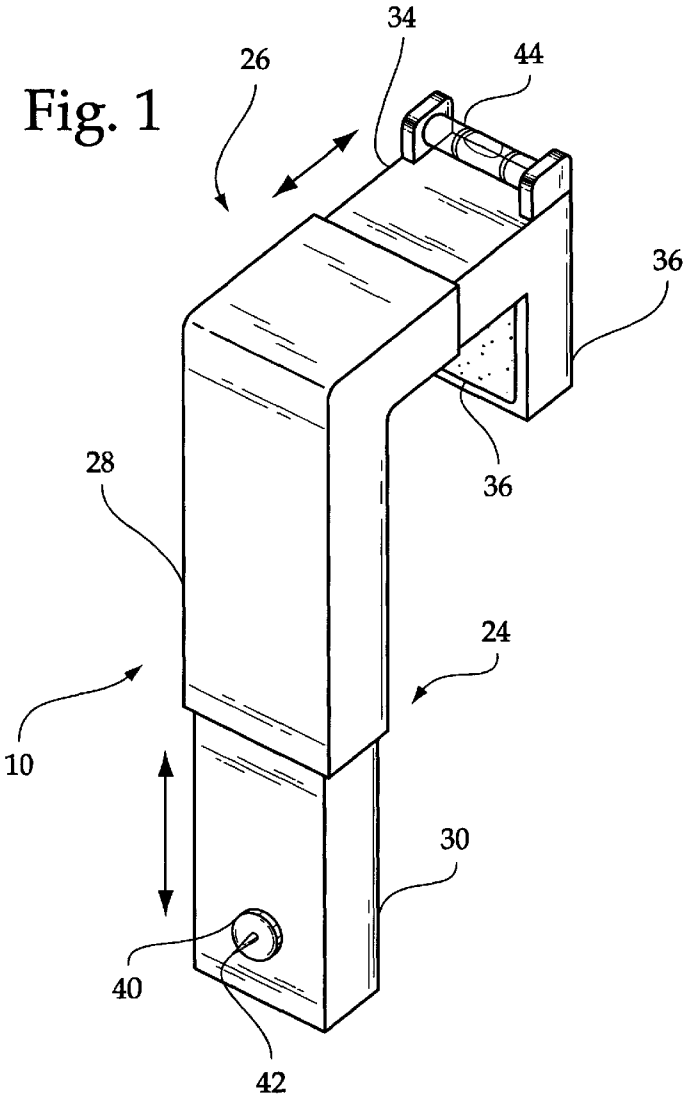
FIG. 1 is a perspective view of the preferred embodiment of the device to assist in proper picture hanging constructed in accordance with the principles of the present invention.
Figure 3:
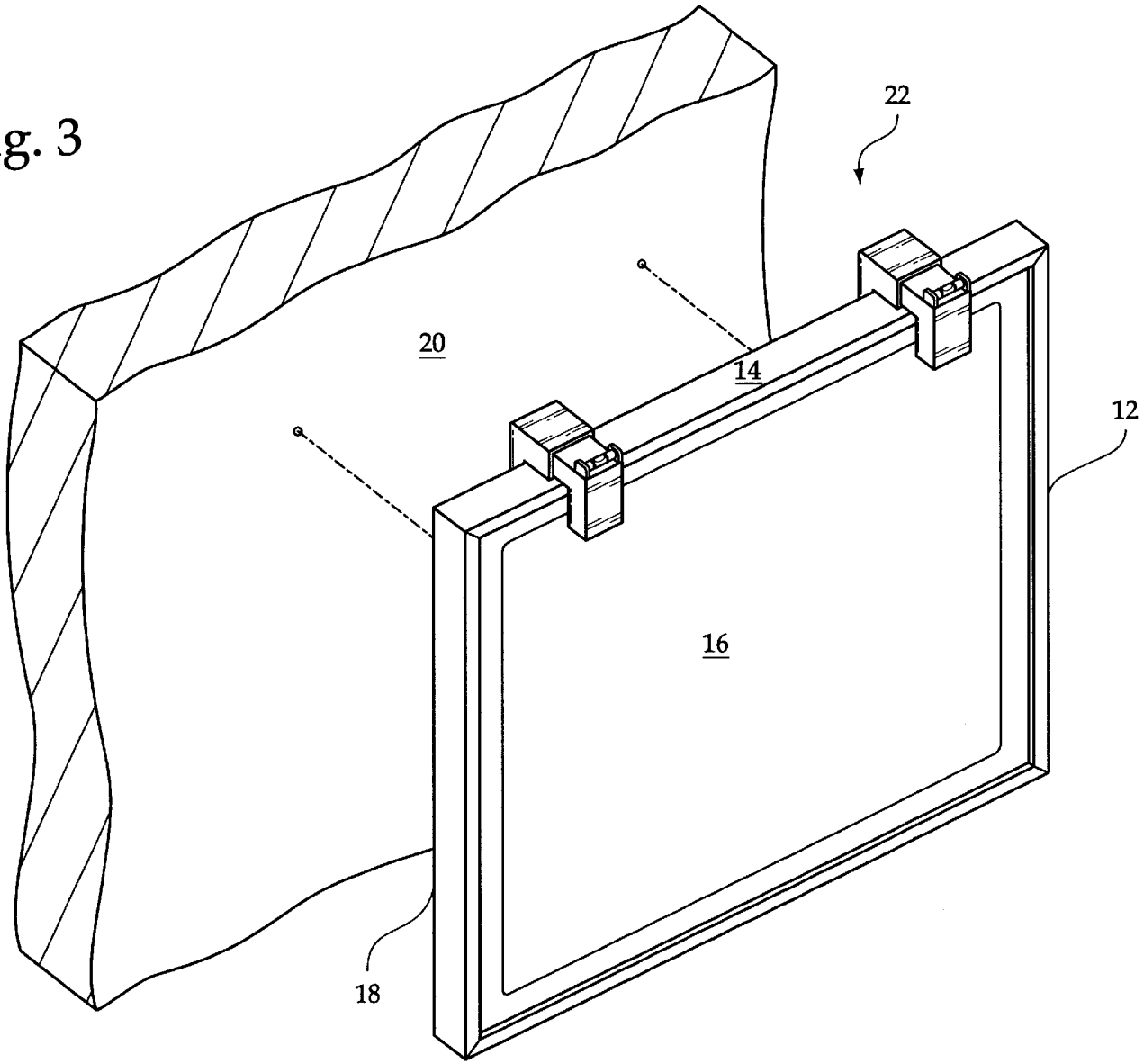
FIG. 3 is a perspective view of the present invention illustrated in use.

With reference now to the drawings, and in particular, to FIGS. 1 through 3 thereof, the preferred embodiment of the new and improved device to assist in proper picture hanging embodying the principles and concepts of the present invention and generally designated by the reference number 10 will be described.

Specifically, it will be noted in the various figures that the device relates to a device to assist in proper picture hanging for allowing framed pictures to be hung straight and in a preferred location in an easy manner. In its broadest context, the device consists of a bracket, a marking protrusion, and a level. Such components are individually configured and correlated with respect to each other so as to attain the desired objective.

The present invention is essentially designed for use with a frame picture 12. The framed picture 12 includes an upper edge 14, a front face 16, and a back face 18. The back face 18 is provided with hooks thereon to allow the framed picture to be hung on a wall 20.

The bracket 22 has a generally inverted J-shaped configuration. The bracket 22 is comprised of an adjustable vertical component 24 and an adjustable horizontal component 26. The vertical component 24 includes an upper segment 28 and a lower segment 30 slidably coupled together. The horizontal component 26 includes an inner segment 32 and an outer segment 34 slidably coupled together. The outer segment 34 has a free end with a downwardly extending lip 36. The inner segment 32 is secured to the upper segment 28 in an orthogonal relationship. Note FIGS. 1 and 2. The vertical component 24 and the horizontal component 26 each have an interior surface coated with a protective coating 36. The bracket 22 is positionable with respect to the framed picture 12 with the horizontal component 26 spanning the upper edge 14 and the vertical component 24 positioned on the back face 18. The protective coating 36 will prevent the framed picture 12 from being damaged by the positioning of the bracket 22. It should be noted that more than one bracket 22 can be used with a framed picture 12, depending on the size of the picture and the number of hooks used as support.

The marking protrusion 38 is secured to the lower segment 30 of the vertical component 24 of the bracket 22. The marking protrusion 38 includes a padded disk 40. The padded disk 40 has a pointed member 42 extending outwardly therefrom. When the bracket 22 is positioned on the framed picture 12, the vertical component 24 is adjusted so that the marking protrusion 38 is aligned with the hooks on the back face 16. Once this is accomplished the framed picture 12 can be positioned in a desired location and then pressed inwardly so that the pointed member 42 can make a small hole or a small mark to indicate where a nail should be placed to properly hang the picture 12. Note FIG. 3.

The level 44 is secured to the outer segment 34 of the horizontal component 26 of the bracket 22. The level 44 will assist in the proper positioning of the picture to hang.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A device to assist in proper picture hanging for allowing framed pictures to be hung straight and in a preferred location in an easy manner, wherein the framed pictures including an upper edge, a front face, and a back face, the back face having hanging hooks disposed thereon, the device comprising, in combination:

a bracket having a generally inverted J-shaped configuration, the bracket being comprised of an adjustable vertical component and an adjustable horizontal component, the vertical component including an upper segment and a lower segment slidably coupled together, the horizontal component including an inner segment and an outer segment slidably coupled together, the outer segment having a free end with a downwardly extending lip, the inner segment being secured to the upper segment in an orthogonal relationship, the vertical component and the horizontal component each having an interior surface coated with a protective coating, the bracket being positionable with respect to the framed picture with the horizontal component spanning the upper edge and the vertical component positioned on the back face;

a marking protrusion secured to the lower segment of the vertical component of the bracket, the marking protrusion including a padded disk, the padded disk having a pointed member extending outwardly therefrom; and a level secured to the outer segment of the horizontal component of the bracket.

2. A device to assist in proper picture hanging for allowing framed pictures to be hung straight and in a preferred location in an easy manner, wherein the framed pictures including an upper edge, a front face, and a back face, the back face having hanging hooks disposed thereon, the device comprising, in combination:

a bracket having a generally inverted J-shaped configuration, the bracket being comprised of an adjustable vertical component and an adjustable horizontal component, the bracket being positionable with respect to the framed picture with the horizontal component spanning the upper edge and the vertical component positioned on the back face;

a marking protrusion secured to the vertical component of the bracket.

3. The device to assist in proper picture hanging as set forth in claim 2, wherein the vertical component includes an upper segment and a lower segment slidably coupled together, the horizontal component including an inner segment and an outer segment slidably coupled together, the outer segment having a free end with a downwardly extending lip.

4. The device to assist in proper picture hanging as set forth in claim 2, wherein the vertical component and the horizontal component each have an interior surface coated with a protective coating.

5. The device to assist in proper picture hanging as set forth in claim 2, wherein the marking protrusion includes a padded disk, the padded disk having a pointed member extending outwardly therefrom.

6. The device to assist in proper picture hanging as set forth in claim 2, and further including a level secured to the horizontal component of the bracket.

* * * * *